United States Patent [19]

Bolton

[11] 3,974,997

[45] Aug. 17, 1976

[54] CASTING APPARATUS WITH THREE-PART CORE

[75] Inventor: Albert Edward Bolton, Birmingham, England

[73] Assignee: Aeroplane & Motor Aluminium Castings Limited, Birmingham, England

[22] Filed: Apr. 1, 1974

[21] Appl. No.: 456,747

[30] Foreign Application Priority Data

Apr. 18, 1973 United Kingdom ..... 18811/73

[52] U.S. Cl. ..... 249/142; 249/184

[51] Int. Cl.[2] ..... B22D 15/00; B28B 7/18

[58] Field of Search ..... 249/184, 185, 142; 425/468; 164/368

[56] References Cited

UNITED STATES PATENTS 2,181,257 11/1939 Arbogast ..... 249/184 UX 3,095,613 7/1963 Christensen et al. ..... 249/184 X 3,545,718 12/1970 Shale ..... 249/185

*Primary Examiner*—Robert D. Baldwin

*Attorney, Agent, or Firm*—Brisebois & Kruger

[57] ABSTRACT

A method and apparatus for producing a casting having a curved internal passage includes die or mould means and core means including at last three parts, said parts being dimensioned and arranged to abut one another so that at least part of the joint line on the surface of the curved passage lies on a surface of revolution accessible from one end of said passage, two of said parts being capable of withdrawal along their respective axes from the ends of the passage, the third core part being of metal, and being arranged to define the inside portion of the curve of the passage, and being dimensioned so that its width is less than the diameter of the curved portion of the passage, whereby said third core part may be withdrawn from said passage.

6 Claims, 8 Drawing Figures

CASTING APPARATUS WITH THREE-PART CORE

This invention relates to castings, and in particular to apparatus for producing a casting having a curved internal passage, and to a casting having an internal passage.

According to one aspect of the invention, a method of producing a casting having a curved internal passage includes the steps of arranging multi-part core means in a die, of which core a first part defines one part of said passage, a second part defines another part of said passage, and a third part defines at least the inner part of the curved portion of the passage, said third part fitting into but being separate from said second part, and said third part abutting said first part in a rectilinear part of said passage, said third core part being of metal; filling said die with molten metal to form the casting on solidification, removing said first and second core parts from the respective parts of said passage, and finally withdrawing said third core part.

According to another aspect of the invention, apparatus for producing a casting having a curved internal passage includes die or mould means and core means including at least three parts, said parts being dimensioned and arranged to abut one another so that at least part of the joint line on the surface of revolution accessible from one end of said passage, two of said parts being capable of withdrawal along their respective axes from the ends of the passage, the third core part being of metal, and being arranged to define the inside portion of the curve of the passage, and being dimensioned so that its width is less than the diameter of the curved portion of the passage, whereby said third core part may be withdrawn from said passage.

the above method and apparatus may be applied to die-casting, especially gravity and high-pressure die-casting, and the core means may include or consist of metal cores.

According to another aspect of the invention, a casting includes a passage having two end portions, each of which progressively increases in area towards the respective outside face of the casting, the end portions being joined by a curved portion the inside suface of the curved portion, as cast, being a smooth curve. Preferably at each of its ends the curved portion merges smoothly with the respective end portion, though a small step may be provided which preferably provides an increase of area of the passage in the intended direction of flow.

Figure 1:
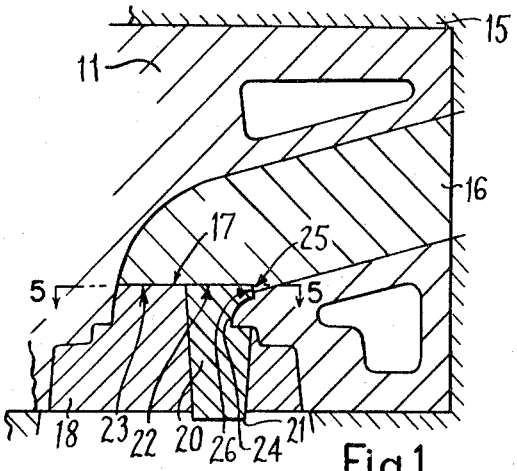
Figure 3:
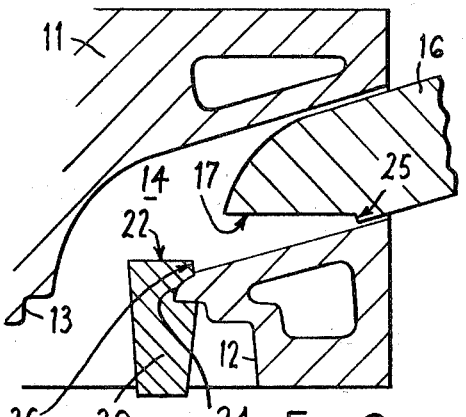
Figure 4:
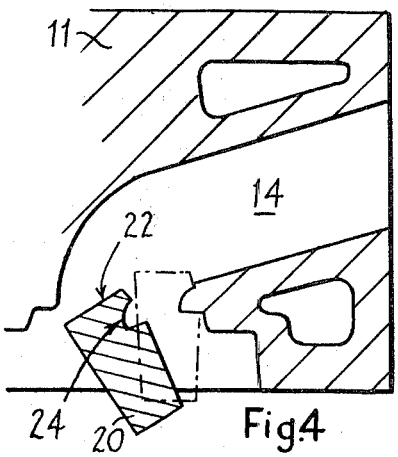
Figure 5:
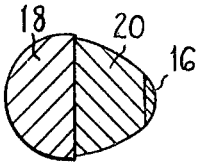
Figure 6:
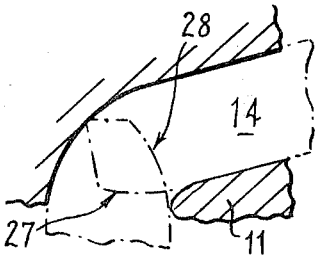
Figure 7:
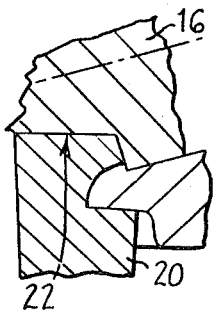
Figure 8:
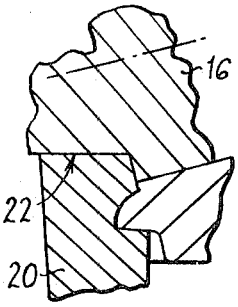

One embodiment of the invention will now be described by way of example with reference to the accompanying drawings, of which FIGS. 1 – 4 are cross-sections through a casting, illustrating diagrammatically different stages of the process, FIG. 5 is a cross-section on the line 5—5 of FIG. 1, FIG. 6 illustrates diagrammatically machining operations, and FIGS. 7 and 8 show alternative details of FIG. 1.

Referring to FIGS. 1 – 5, there is shown part of a cylinder head casting 11 for an internal combustion engine, with core parts in position. In use, the lower surface of the casting (as seen in the drawings) mates with the cylinder block, and this surface has a recess 12 formed in it to provide the combustion space of the cylinder, and a rebate 13 to receive a valve seat insert. The right-hand side (as seen) of the casting mates with the corresponding inlet or exhaust manifold, and the casting is provided with a curved circular-section passage 14, from the valve seat rebate 13 for the inlet or exhaust valve to the corresponding side face of the casting.

The casting is cast in a die 15 in known manner, for example by gravity die-casting or high-pressure die-casting techniques (otherwise known as permanent mould casting and pressure die-casting respectively), and the recess 12, rebate 13, and curved passage 14 are formed by a three-part core.

The multi-part core is arranged in the die 15 as shown in FIG. 1. The first part 16 of the core is conical over the major part of its length, having a small cone angle, the large diameter being at the outer end. It will be noted that on the inside of the curve in the passage 14 (i.e. on the lower side in the figures) the first core part 16 is rectilinear in section and does not continue round the curve. On the outside of the curve, the first core part 16 forms a portion of a body of revolution, and this core part terminates substantially in a flat plane surface 17.

The second core part 18 is in the form of a body of revolution from which a portion has been removed. It also has a small cone angle, the larger diameter being at the outer end, and has parts defining the recess 12, the rebate 13, and part of the outside of the curved passage 14. This second core part has a hole 19 passing right through it, which accomodates the third core part 20.

The latter has a portion 21 extending through the hole 19 to provide a tail which is located in the die 15; the other end of the third part has a plane surface 22 which is flush with a plane surface 23 on the second part, and both abut the plane surface 17 on the first part. The third part 20, moreover, has a portion 24 which defines the inside portion of the curve of the passage 14, that is, for somewhat less than 180° about the centre of the passage. Moreover, the transverse dimension of the third part 20 is just less than the radius of the corresponding portion of the passage 14 (see FIG. 5), to enable the third part to be withdrawn, as will be described below.

The three core parts 16, 18, 20 are preferably of steel where the casting is of light alloy, i.e. aluminium or magnesium alloy, though instead of "permanent" i.e. re-usable cores one or both the first and second core parts could be replaced by a non re-usable core, e.g. a sand core, or a shell-moulded or soluble core. The third core part 20 will, however, always be of metal, preferably steel, or it may be of nickel alloy.

Figure 2:
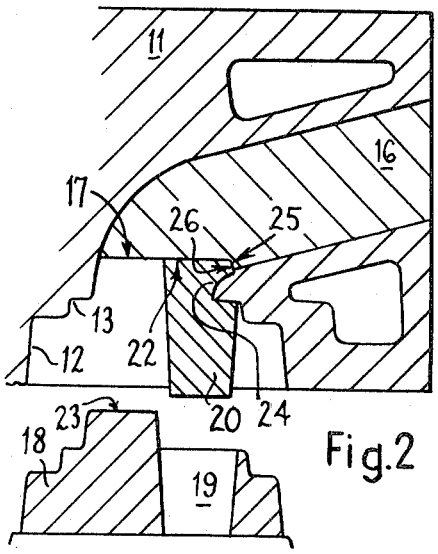

After the core parts have been arranged in the die as seen in FIG. 1, the molten metal, e.g. aluminium is poured or injected into the die cavity, and the first and second core parts 16, 18 are then withdrawn in directions along their respective axes, as seen respectively in FIGS. 3 and 2. The third core part 20 may then be removed with an initial inward movement (towards the centre of the passage 14); since the diameter of the passage 14, at right angles to the plane of the paper, is greater than the parallel dimension of this core part 20 (see FIG. 5), this allows the core part to be removed as seen in FIG. 4.

The first and third core parts 16, 20, may be provided with a small step 25, 26, to ensure that the joint line of the core parts is at right angles to the local surface of the casting. It will be noted that part of the joint line, formed by planes 17, 22, 23 and step 25, 26, on which flash may occur on the casting, occurs in a region whch may be machined by a cutter 27, as shown in FIG. 6, inserted through the side face of the casting, and a further part of the joint line may be machined by a cutter 28 inserted through the lower face (as seen) of the casting. In this way any flash left on the entire joint line may be completely machined off by cutters 27 and 28. Moreover, the third core part 20, being of metal, may have a smooth finish on the portion 24 which defines the inside of the curved passage 14, so that the latter may have a good finish, and give good flow characteristics in the engine.

Preferably the curved portion 24 merges smoothly with the rebate 13 and the portion defined by the first core part 16, but a slight difference may be made between the curved passages 14 for the exhaust and inlet, as shown in FIGS. 7 and 8, in order to ensure that the passage increases in size in th direction of flow. Thus the first core part 16 may overlap the third part 20 in the exhaust passage as seen in FIG. 7, and vice versa in the inlet passage as seen in FIG. 8. The step is exaggerated in the drawing, for the purpose of illustration.

It will be appreciated that, although the first and second core parts 16, 18, may be of sand, the invention is more advantageously used in die-casting processes employing metal cores. Not only are the cost and handling problems of sand cores absent when employing metal cores, but the insertion and removal of the cores may be more readily mechanised.

Although the invention has been described by reference to the casting of an aluminium alloy cylinder head having a curved internal passage, it will be clear that it may be used for castings for other purposes.

I claim:

1. Apparatus for producing a metal casting having an internal passage including a curved portion and a straight portion meeting said curved portion, the width of the straight portion being not substantially greater than the width of the curved portion measured in the plane containing the radius of curvature of the central axis of the curved portion, said apparatus including die or mould means to define the external shape of said casting, and core means including first, second and third core parts which abut but are unconnected, and when in abutment define the surface of said internal passage, said first and second core parts being capable of withdrawal along their respective axes from the ends of the passage, said second core part having a hole passing right through it, said third core part being accommodated in said hole, being of metal, being arranged to define the inside portion of the curve of the passage, and having its largest transverse dimension less than the diameter of the corresponding portion of the passage, whereby, after withdrawal of said first and second core parts, the third core part may be removed with an initial inward movement towards the centre of the passage, the core parts being dimensioned and arranged to abut one another so that a face on the first core part is in contact with a face on the second and third core parts to define a joint line positioned so that the impression of the joint line cast on the metal surface of the curved passage lies on surfaces of revolution accessible from the ends of the passage.

2. Apparatus as claimed in claim 1, in which the first core part is of generally conical form over at least part of its length.

3. Apparatus as claimed in claim 1, in which the first core part defines a portion of the outside of the curve of the passage.

4. Apparatus as claimed in claim 1, in which the second core part defines a portion of the outside of the curve of the passage.

5. Apparatus as claimed in claim 1, in which the second core part is provided with portions to define a recess in the passage.

6. Apparatus as claimed in claim 1, in which one end of the third core part has a plane surface which is flush with a plane surface of the second core part and both said plane surfaces abut a plane surface of the first core part, to form at least part of said joint line.

* * * * *